US007217031B2

(12) United States Patent
Bhavnani

(10) Patent No.: US 7,217,031 B2
(45) Date of Patent: May 15, 2007

(54) HANDHELD ELECTRIC DEVICE WITH A SUBSTANTIALLY SEMICIRCULAR SPRING CLIP ASSEMBLY AND AN ADVERTISING METHOD

(75) Inventor: Dilip Bhavnani, Sun Coast Merchandise Corporation, 6315 Bandini Blvd., Commerce, CA (US) 90040

(73) Assignee: Dilip Bhavnani, Beverly Hills, CA (US)

( * ) Notice: Subject to any disclaimer, the term of this patent is extended or adjusted under 35 U.S.C. 154(b) by 215 days.

(21) Appl. No.: 10/754,154

(22) Filed: Jan. 9, 2004

(65) Prior Publication Data

US 2005/0152228 A1 Jul. 14, 2005

(51) Int. Cl.
*A44B 21/00* (2006.01)
*G04B 37/14* (2006.01)

(52) U.S. Cl. ..... 368/316; 24/3.12; 248/316.7

(58) Field of Classification Search ..... 368/316; 24/510, 12, 13, 3.11, 11 R, 3.12, 507, 511, 24/499; 224/269; 128/DIG. 26; 174/135; D13/156; D10/31; 81/440; 248/316.7
See application file for complete search history.

(56) References Cited

U.S. PATENT DOCUMENTS

| | | | | | |
|---|---|---|---|---|---|
| 753,858 | A | * | 3/1904 | Cram | 24/508 |
| 1,266,962 | A | * | 5/1918 | Lawlor | 211/32 |
| 2,509,428 | A | * | 5/1950 | Wallace | 224/670 |
| 4,127,921 | A | | 12/1978 | Townsend | |
| 4,496,058 | A | * | 1/1985 | Harris et al. | 40/308 |
| D283,403 | S | * | 4/1986 | Chan | D10/40 |
| 4,646,394 | A | | 3/1987 | Kraus | |
| 4,667,375 | A | | 5/1987 | Enlund | |
| 4,707,906 | A | | 11/1987 | Posey | |
| 4,892,334 | A | * | 1/1990 | Sinclair | 281/45 |
| D313,758 | S | * | 1/1991 | Klose | D10/31 |
| 5,145,141 | A | * | 9/1992 | Hunter | 248/452 |
| 5,309,604 | A | | 5/1994 | Poulsen | |
| 5,309,607 | A | | 5/1994 | Hohmann | |
| 5,361,459 | A | * | 11/1994 | Hyvonen et al. | 24/35 |
| 5,489,075 | A | | 2/1996 | Ible | |
| 5,542,155 | A | | 8/1996 | Kimura | |
| 5,639,049 | A | | 6/1997 | Jennings | |
| 5,769,740 | A | * | 6/1998 | Colangelo | 473/408 |
| 5,979,020 | A | | 11/1999 | Kimura | |
| 6,192,555 | B1 | | 2/2001 | Nakamura | |
| 6,343,407 | B1 | | 2/2002 | Muto | |
| 6,360,999 | B1 | | 3/2002 | Liao | |
| 6,389,650 | B1 | | 5/2002 | Yamada | |
| 6,490,768 | B1 | | 12/2002 | Goodall | |
| 6,507,267 | B2 | | 1/2003 | Russell | |
| 6,523,230 | B1 | | 2/2003 | Weinhold | |
| 6,523,231 | B1 | | 2/2003 | Lassiter | |
| 6,564,432 | B1 | * | 5/2003 | Kushner | 24/3.3 |

* cited by examiner

*Primary Examiner*—Vit Miska
*Assistant Examiner*—Sean Kayes
(74) *Attorney, Agent, or Firm*—The Soni Law Firm

(57) ABSTRACT

A device housing with a generally semicircular clip assembly for attaching the device housing to a cylindrical object, for example tubing, is disclosed. The clip assembly includes a helical coil spring for biasing the generally semicircular clip against the device housing. In the preferred embodiment, a timekeeping device is incorporated within the device housing. The device housing with timekeeping device may be securely clipped to stethoscope tubing. Also disclosed in the present invention is an inexpensive method of placing multicolor advertising upon a device housing.

19 Claims, 2 Drawing Sheets

HANDHELD ELECTRIC DEVICE WITH A SUBSTANTIALLY SEMICIRCULAR SPRING CLIP ASSEMBLY AND AN ADVERTISING METHOD

BACKGROUND OF THE INVENTION

1. Field of the Invention

The present invention relates to a device housing with a generally semicircular clip assembly. More specifically, the present invention relates to means for attaching the housing of a digital clock to a cylindrical support, for example, the rubber tubing on a stethoscope. The present invention also related to an inexpensive method for exposing advertising to potential customers through placement of advertising on such a device housing.

2. Description of the Prior Art

Digital clocks with a LCD display have been known for many years. These clocks are common on watches and kitchen timers. These devices commonly incorporate a flat clip attached on the back of the housing in order to removably secure the device to a fixation point. In addition to clocks, various other devices, such as pens, digital devices, pagers, and telephones often include clips so that the device may be removably secured to a fixation point.

Typically the structure of clips is straight and flat. Such clips are designed to attach the device to flat objects such as shirt pockets, belts, and car visors. Many of these types of clips have a spring biased mechanism that allows the clip to open and close, facilitating the application and removal of the associated device. Examples of these types of flat clips are disclosed in U.S. Pat. No. 276,512 to Webster, U.S. Pat. No. 5,075,931 to van Kuijk, U.S. Pat. No. 5,361,459 to Hyvonen, and U.S. Pat. No. 5,678,281 to Kamp. A problem with these types of flat clips is that they do not work well, if at all, when used to secure a device to a cylindrical fixation point, for example, tubing or hoses. The clips dislodge from the fixation point easily and the tubing can be compressed by flat spring biased clips.

There are other clips that are designed to secure to cylindrically shaped objects, for example, tubing and hoses. Circular hose clips as disclosed for example in U.S. Pat. No. 6,389,650 to Yamada and in U.S. Pat. No. 5,309,607 to Hohmann. These are not designed to be integrated into a device housing. Furthermore, although these may grip a hose or tubing, they are not readily removable without tools. Therefore these hose clamps are inappropriate for attaching an associated device housing. Another type of clip for holding a tube is a shaped pre-bent single piece of resilient metal or plastic such as that disclosed in U.S. Pat. No. 6,507,267 to Russell. Similarly, U.S. Pat. No. 4,707,906 to Posey discloses a tube holder made from a narrow, elongated, thin, flat, semi-rigid strip of pre-bent spring metal such as stainless steel that is adapted for use with a given standard size hospital tubing. Those types of clips are without any coiled spring biasing mechanism and operate merely by leaf spring type biasing of a pre-bent metal strip. As such, they can be difficult to place and remove, may compress the tubing, usually fit only one particular diameter of tubing, and may fail early due to metal fatigue. Another type of specialty clip is the carabineer. U.S. Pat. No. 6,527,438 discloses a carabineer incorporation a timekeeping functionality. A carabineer however would not hold securely to a cylindrical fixation point.

What is lacking in the prior art is a device that will securely and removably attach a device housing to a cylindrical fixation point such as tubing.

SUMMARY OF THE INVENTION

It is accordingly an object of the present invention to provide a clip that securely and removably attaches a device housing to a cylindrical fixation point.

Another object of the present invention is to provide a clip that is easily attached and removed from cylindrical fixation points without tools or excessive force.

It is yet another object of the present invention to provide a clip that will not readily compress soft rubber cylindrical tubing.

Still another object of this invention is to provide a helical coiled spring biased clip upon a digital clock housing, that will permit the housing to be removably secured to stethoscope tubing without compressing the tubing or impairing the functioning of the stethoscope.

Yet another object of this invention is to provide an inexpensive way to place multicolor advertising upon a device housing, such as a digital clock. The advertising is bright and gets the attention of the consumer and others.

The objects of this invention are accomplished by providing a helical coil spring biased clip attached to a device housing. In the preferred embodiment, the device housing incorporates a digital clock. Furthermore, a transparent cover attaches to said housing such that a multicolor advertising insert may be placed between said housing and said transparent cover.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

The device housing with attached clip assembly of the present invention comprises a generally semicircular rigid clasp having a proximal end with clasp flanges pivotally engaging a pair of housing flanges, and a distal end spring biased against a rear side of said housing; a guide pin pivotally engaging the clasp flanges with the housing flanges; and; a helical coil spring surrounding said guide pin wherein said distal end of the generally semicircular rigid clasp is biased against the device housing.

BRIEF DESCRIPTION OF THE DRAWINGS

The foregoing objects, features, advantages and preferred embodiments of the device and method of the present invention will be better understood from the following detailed description taken in conjunction with the accompanying drawings in which.

DETAILED DESCRIPTION

The accompanying Figures depict embodiments of the present invention, and features and components thereof. With regard to means for fastening, mounting, attaching or connecting the components of the present invention to form the apparatus as a whole, unless specifically described otherwise, such means are intended to encompass conventional fasteners such as machine screws, machine threads, snap rings, hose clamps such as screw clamps and the like, rivets, nuts and bolts, toggles, pins and the like. Components may also be connected by friction fitting, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, molding and machining may be used. Any references to front and back, right and left, top and bottom, upper and lower, and horizontal and vertical are intended for convenience of description, not to limit the present invention or its components to any one positional or spacial orientation.

Figure 1:
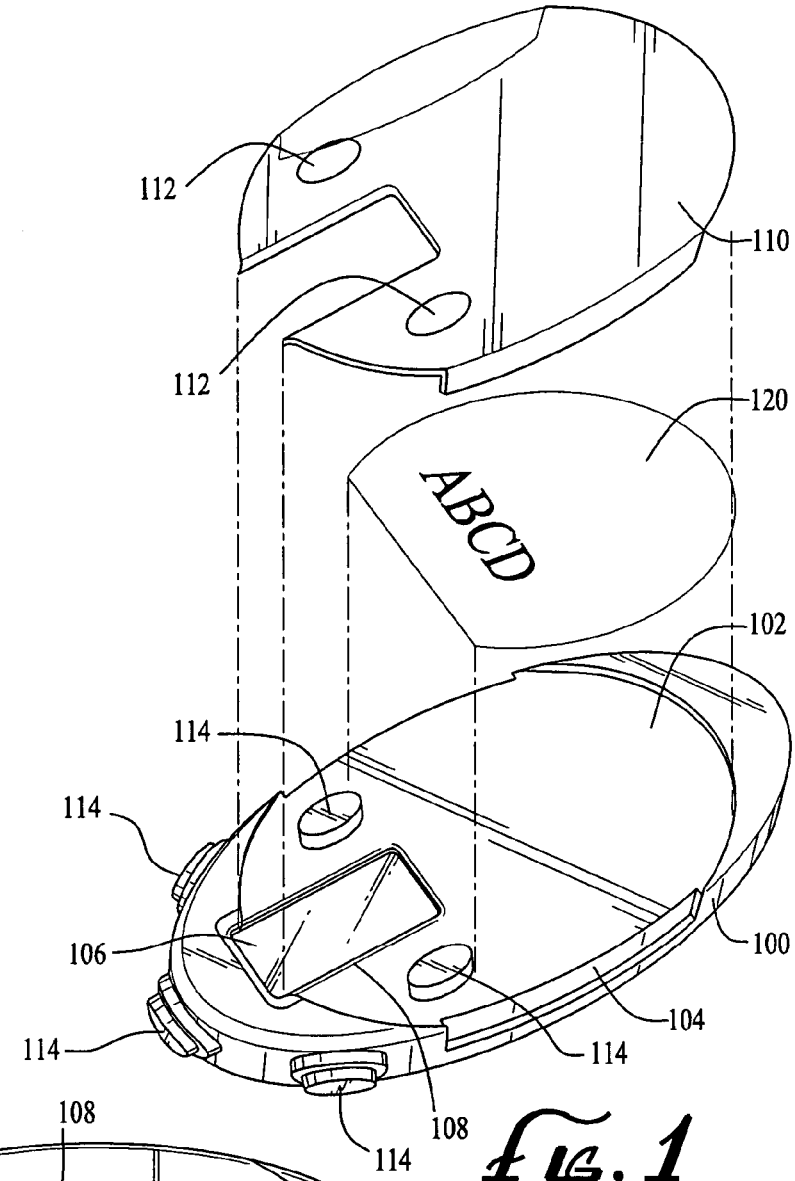
FIG. 1 is an exploded prospective view of the present invention demonstrating the placement of advertising between a device housing and a fitted transparent advertising cover.

Referring to the drawings, FIG. 1 shows an exploded view of a device housing 100 of the present invention. The device housing 100 in the preferred embodiment is plastic and oblong, however the housing in other embodiments may comprise various materials and be made in various shapes, sizes, and colors. Various functional devices, for example clocks, pagers, and flashlights, may be incorporated within the device housing.

In the preferred embodiment, the device housing incorporates a timekeeping functionality. The timekeeping functionality in this particular embodiment is a digital clock. Details of the structure and function of the timekeeping functionality, such as the inner electrical and/or mechanical components are omitted herein as such functionality would be well understood by one skilled in the art. It should also be understood that alternatively, the timekeeping functionality could be an analog clock.

In the preferred embodiment, a molded depression 102 in the device housing accommodates a fitted transparent advertising cover 110. The advertising cover 110 may have openings 112 for a LCD and various function switches 114. The advertising cover 110 snap fits into indentations 104 on the sides of the device housing 100. An advertising insert 120, preferably multicolor and with various indicia upon it, may be inserted between the transparent advertising cover 110 and the device housing 100, wherein the advertising is displayed. The transparent advertising cover 110 may also be securely attached into position with glue or screws, in order to discourage the advertising insert from being removed.

Figure 2:
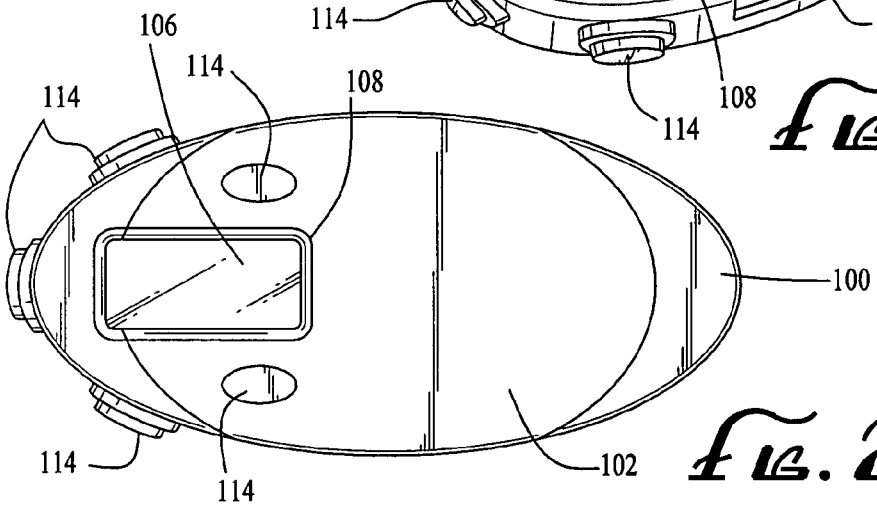
FIG. 2 is a top view of the assembled preferred embodiment of the present invention.

Referring also now to FIG. 2, the components of the timekeeping device in this preferred embodiment may include a LCD display panel 106. A sound emitting piezoelectric diaphragm may be included within the device housing. The LCD display panel 106 fits in, and is displayed through, a rectangular opening 108 in the housing. In this preferred embodiment, there are other openings in the housing to accommodate the passage of electrical push button switches 114, provided to program the timekeeping functions. An LED light may also be incorporated within the housing to illuminate the LCD display 106.

Figures 3, 4, 5, 6:
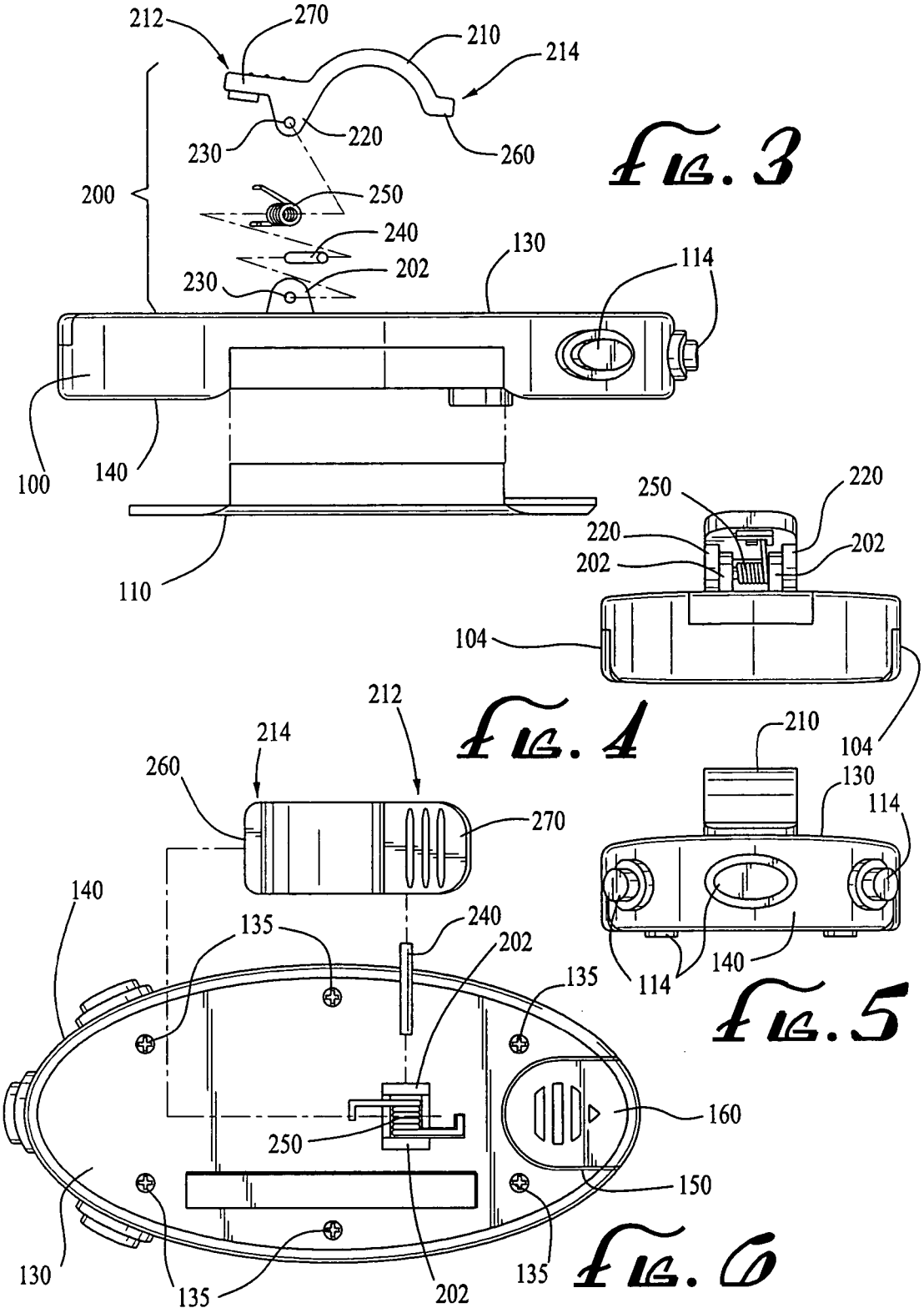
FIG. 3 is a side exploded view of the preferred embodiment of the present invention illustrating a generally semicircular clip and the fitted transparent advertising cover.
FIG. 4 is a posterior view of the generally semicircular clip assembled to the device housing of the preferred embodiment.
FIG. 5 is an anterior view of the clip assembled to the housing of the preferred embodiment.
FIG. 6 is a rear view of the housing of the preferred embodiment illustrating the generally semicircular clip disassembled from the housing.

As shown in FIG. 3 and FIG. 4, a clip assembly 200 is mounted to the housing rear section. The clip assembly 200, in the preferred embodiment, comprises a pair of housing flanges 202 that are integrated into a housing rear section 130 of the device housing 100. The clip assembly 200 further comprises, a generally semicircular rigid clasp 210, comprising a proximal end 212 and a distal end 214. Associated with the proximal end 212 of the generally semicircular rigid clasp 210 are a pair of clasp flanges 220 that pivotally engage the housing flanges 202. An axially aligned hole 230, in each of the clasp flanges 220 and the housing flanges 202, accepts a transversely positioned guide pin 240. With the guide pin 240 in place, the clasp flanges 220 may pivotally rotate upon the housing flanges 202. A helical coil spring 250, surrounding the outside of the guide pin 240 and located between the two housing flanges 202, biases the distal end 214 of the generally semicircular rigid clasp 210 against the housing rear section 130. One end of the helical coil spring 250 contacts the device housing rear section 130 and the other end contacts the generally semicircular rigid clasp 210. Additionally, in the preferred embodiment, on the distal end 214 of the generally semicircular rigid clasp 210 is a foot plate 260, and extending from the proximal end of the clasp is a leverage arm 270.

Although the above clip assembly may be used upon a timekeeping device, such as the preferred embodiment, those skilled in the art will readily recognize that this clip assembly may also be connected with pens, pagers, name tags, signs, tags, and other devices, wherever attachment to a cylindrical object such as a pole, hose, or tube is desired.

In the preferred embodiment the generally semicircular rigid clasp is a semicircle. However, the generally semicircular rigid clasp of the present invention could comprise various other shapes that are capable of accommodating without compressing tubing, for example, arched, humped, or angled shapes, wherein said angle is less than 180 degrees on the side of the clasp closest to the housing.

Referring to FIG. 5 and FIG. 6, the device housing 100 is comprised of a housing front section 140 and the housing rear section 130 that are attached to each other in the preferred embodiment via housing screws 135. Alternatively, the housing front section and housing rear section may be snap fit or glued together.

The housing, in this preferred embodiment, also comprises a removable power supply, for example a watch battery. There is a battery access port 150, and a removable battery cover 160, in the housing rear section 130, whereby the battery may be changed.

The present invention also includes a method of advertising upon a device housing. The method comprises placing printing, for example multi-colored advertising indicia, upon an insert 120, placing said insert 120 between a device housing 100 and a transparent advertising cover 110, and attaching the transparent advertising cover 110 to the device housing 100, wherein the advertising is displayed, and finally, exposing said device housing to a consumer.

The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A portable device-clip assembly comprising:

(a) a portable handheld device housing comprising a rear housing section and a substantially opposed front housing section, said sections being connected together to define a compartment bounded thereby, said device housing further comprising housing flanges perpendicularly protruding from an outer surface of said rear housing section;

(b) a substantially semicircular rigid clasp having a distal end, a proximal end, and a substantially semicircular clasp body, said clasp comprising clasp flanges formed adjacent the proximal end;

(c) a guide pin pivotally engaging said clasp flanges with said housing flanges, thereby pivotally connecting said clasp to said device housing, said clasp flanges and housing flanges being configured and oriented such that the substantially semicircular clasp body is positioned substantially perpendicularly to said rear housing section, defining a substantially semicircular clasping aperture therebetween;

(d) a helical coil spring surrounding said guide pin and resiliently biasing the distal end of said substantially semicircular rigid clasp against said rear housing section, whereby a generally tube-shaped article is releaseably clasped between the clasp body and said rear housing section perpendicularly through the substantially semicircular clasping aperture;

(e) electric circuitry encased within said compartment; and (f) at least one input unit for controlling said electric circuitry formed on an outer surface of said device housing.

2. The device-clip assembly as in claim 1, wherein said substantially semicircular rigid clasp further includes a foot plate and a leverage arm.

3. The device-clip assembly as in claim 2, wherein said clasp flanges, foot plate, and leverage arm are integrally formed with said clasp and said housing flanges are integrally formed with said device housing.

4. The device-clip assembly as in claim 1, wherein said front housing section defines an advertising portion on an outer surface thereof, and said device housing further comprises:

(a) a transparent advertising cover disposed upon the advertising portion; and (b) advertising indicia disposed between said transparent advertising cover and the advertising portion of said front housing section of said device housing.

5. The device-clip assembly as in claim 4, wherein the advertising portion has a greater than the rest area of the outer surface of said front housing section.

6. The device-clip assembly as in claim 5, wherein said device housing further comprises an insert disposed between said transparent advertising cover and the advertising portion, and said advertising indicia are imprinted upon said insert.

7. The device-clip assembly as in claim 4, wherein the advertising portion is a recess having a depth equal to the thickness of said transparent cover.

8. The device-clip assembly as in claim 1, wherein said electric circuitry is a digital alarm clock and timer.

9. The device-clip assembly as in claim 8, wherein said device housing-clip assembly further comprises a LCD panel for displaying digital signals generated by said clock and timer, and said front housing section defines on an outer surface thereof a LCD window sized and configured to fit said LCD panel therein.

10. The device-clip assembly as in claim 9, wherein said substantially semicircular rigid clasp further includes a foot plate and a leverage arm.

11. The device-clip assembly as in claim 10, wherein said clasp flanges, foot plate, and leverage arm are integrally formed with said clasp and said housing flanges are integrally formed with said device housing.

12. The device-clip assembly as in claim 9, wherein said front housing section further defines an advertising portion on the outer surface thereof that is not occupied by said LCD window, and said device housing further comprises:

(a) a transparent advertising cover disposed upon the advertising portion; and (b) advertising indicia disposed between said transparent advertising cover and the advertising portion of said front housing section of said device housing.

13. The device-clip assembly as in claim 12, wherein the advertising portion has a greater area than the rest of the outer surface of said front housing section.

14. The device-clip assembly as in claim 13, wherein the advertising portion is a recess having a depth substantially equal to the thickness of said transparent cover.

15. The device-clip assembly as in claim 14, wherein said device housing further comprises an insert disposed between said transparent advertising cover and the recess, and said advertising indicia are imprinted upon said insert.

16. The device-clip assembly as in claim 12, wherein said advertising indicia and the digital signals displayed on said LCD panel are oppositely oriented.

17. A method of advertising and promotion comprising the steps of:

(a) providing a device-clip assembly comprising:

(1) a portable handheld device housing comprising a rear housing section and a substantially opposed front housing section, the sections being connected together to define a compartment bounded thereby, the front housing section defining an advertising portion on an outer surface thereof, the device housing further comprising housing flanges perpendicularly protruding from an outer surface of the rear housing section, (2) a generally semicircular rigid clasp having a distal end, a proximal end, and a substantially semicircular clasp body, the clasp comprising clasp flanges formed adjacent the proximal end, (3) a guide pin pivotally engaging the clasp flanges with the housing flanges, thereby pivotally connecting the clasp to the device housing, the clasp flanges and housing flanges being configured and oriented such that the substantially semicircular clasp body is positioned substantially perpendicularly to the rear housing section, defining a substantially semicircular clasping aperture therebetween, (4) a helical coil spring surrounding the guide pin and resiliently biasing the distal end of the substantially semicircular rigid clasp against the rear housing section, whereby a generally tube-shaped article is releaseably clasped between the clasp body and the rear housing section perpendicularly through the substantially semicircular clasping aperture, (5) electric circuitry encased within the compartment; and (6) at least one input unit for controlling the electric circuitry formed on an outer surface of the device housing, (b) preparing a transparent advertising cover;

(c) disposing advertising indicia upon the advertising portion of the front housing section; and (d) removably attaching the transparent cover upon the front housing section such that the advertising indicia are displayed through the transparent cover.

18. The method of advertising and promotion as in claim 17, wherein the advertising portion has a greater area than the rest of the outer surface of said front housing section.

19. The method of advertising and promotion as in claim 17, wherein the step of disposing advertising indicia comprises the steps of:

(a) preparing an insert;

(b) imprinting advertising indicia upon the insert; and (c) placing the insert upon the advertising portion of the front housing section.

* * * * *